United States Patent [19]

Schmit

[11] 3,995,773

[45] Dec. 7, 1976

[54] FLEXIBLE LIQUID CONTAINING AND DISPENSING DEVICE

[75] Inventor: Justin M. Schmit, Pompano Beach, Fla.

[73] Assignee: Arctic Pac, Inc., Fla.

[22] Filed: Dec. 17, 1975

[21] Appl. No.: 641,660

Related U.S. Application Data

[63] Continuation-in-part of Ser. No. 448,617, March 6, 1974.

[52] U.S. Cl. ..... 222/91

[51] Int. Cl.[2] ..... B67B 7/28

[58] Field of Search ..... 222/81–91, 222/541

[56] References Cited

UNITED STATES PATENTS

| | | | |
|---|---|---|---|
| 2,058,910 | 10/1936 | Plunkett | 222/89 X |
| 2,612,765 | 12/1952 | Gorey | 222/183 |
| 2,873,886 | 2/1959 | Miskel et al. | 222/91 |
| 2,947,653 | 8/1960 | Fohr | 222/541 X |
| 3,128,913 | 4/1964 | Specketer | 222/541 X |
| 3,157,314 | 11/1964 | Nadler | 222/88 |
| 3,226,002 | 12/1965 | Walker | 222/183 X |
| 3,239,104 | 3/1966 | Scholle | 222/89 |
| 3,580,423 | 5/1971 | Gilman | 222/81 |
| 3,809,290 | 5/1974 | Schmit | 222/90 X |

*Primary Examiner*—Allen N. Knowles
*Assistant Examiner*—Norman L. Stack, Jr.
*Attorney, Agent, or Firm*—Schroeder Siegfried Ryan & Vidas

[57] ABSTRACT

A flexible liquid container and dispensing device consisting of a flexible fluid containing pouch having mounted therein a rigid tubular member which is held in position by a sleeve member external thereof, the sleeve member being adapted to mount a pouring structure, the parts thereof being movable relative to the pouch and the tubular member therein for piercing the same to dispense fluid from the pouch. The pouring structure will provide not only a spout for dispensing of the fluid but also a suitable closure for recapping the pouch after usage to retain the balance of the fluid therein.

11 Claims, 7 Drawing Figures

FLEXIBLE LIQUID CONTAINING AND DISPENSING DEVICE

The present application is a continuation-in-part of my co-pending application Ser. No. 448,617 entitled FLUID CONTAINING AND DISPENSING STRUCTURE filed Mar. 6, 1974. This application and my prior U.S. Pat. No. 3,809,290 dated May 7, 1974 and entitled LIQUID CONTAINING AND DISPENSING DEVICE are directed to a flexible liquid containing pouch and an associated holding or mounting structure with particular dispensing means for piercing the wall of the liquid pouch with a pouring structure to permit dispensing of fluids therefrom. In my prior inventions, the dispensing device includes a support structure for the liquid pouch in addition to the pouring structure formed integral therewith.

My invention relates to flexible liquid packaging and a dispensing device associated therewith and more particularly to an improved dispensing device adapted to be used with flexible liquid container and pouch type packaging.

In the present invention, the flexible sealed liquid containing pouch, which includes a tubular element positioned in the upper wall thereof, mounts the pouring structure which includes a mounting means and a tubular piercing element. The piercing element pierces the wall of the flexible pouch positioned over the tubular element to provide fluid communication with the interior of the pouch. The mounting means of the pouring structure also functions to seal the pouch when fluid is not being dispensed. The pouring structure also includes a sleeve frictionally attached over the liquid pouch around the tubular member. Means are provided between the parts of the pouring structure for relative movement to permit movement of the tubular piercing element relative to the pouch to pierce the same. In certain embodiments, the tubular piercing element is spearated from the mounting means after the tubular piercing element has pierced the flexible pouch and is retained within the sleeve on a tubular member to provide for permanent fluid communication therewith. The mounting means may form a separate cap structure for sealing the pouring structure or it may cooperate with the shaped end of the tubular piercing element to form a selectively operable valve. The sleeve is so mounted on the wall of the pouch as to retain the tubular element therein and protect the end wall of the pouch exposed across the tubular element prior to puncturing the same.

It is therefore the general object of this invention to provide an improved dispensing structure for use with flexible liquid containers or packaging.

Another object of this invention is to provide in an improved dispensing device, a detachable tubular piercing element carried by the pouring structure which when brought into piercing relationship with the flexible container is retained therein.

A further object of this invention is to provide in an improved dispensing device, a detachable tubular piercing element carried by the pouring structure which when brought into piercing relationship with the flexible container is retained within the container.

A further object of this invention is to provide an improved dispensing device for a flexible liquid container in which the dispensing device forms a means for piercing the flexible container to open the same and provide a sealed cover after dispensing has taken place.

A still further object of this invention is to provide an improved dispensing device for a flexible liquid container in which the dispensing device provides the means for piercing the flexible container to provide for fliud communication therewith and forms a pouring structure and valve structure for controlling the flow of fluid therefrom.

Another object of this invention is to provide an improved dispensing device for use with a flexible walled liquid container which makes possible a convenient, inexpensive, and practical method for dispensing fluids therefrom.

These and other objects of this invention will become apparent from the reading of the attached description together with the drawings wherein.

Figure 1:
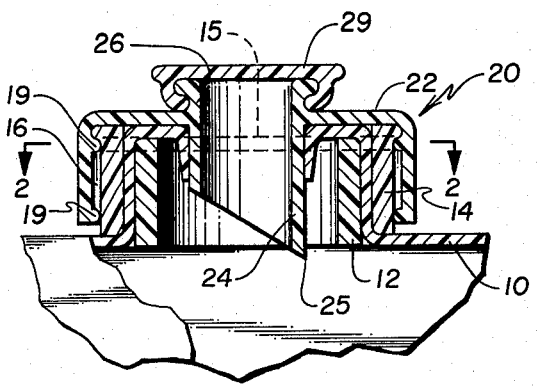
FIG. 1 is a side elevation view of an embodiment of the invention with parts broken away.

My invention in a flexible liquid container dispensing device utilizes the liquid pouch disclosed and described in my above identified patent and co-pending application. The pouch which is indicated generally at 10 and shown only fragmentarily in the drawings is formed of a sheet or pair of sheets of flexible material capable of being secured to one another through the application of heat upon their registering surfaces. The pouch incorporates a rigid tubular member 12 which is positioned in one of the sealed walls of the pouch with the tubular member 12 having a surrounding wall portion drawn or stretched across the same to fit tightly around one end of the tubular member. The remaining portions of the pouch are sealed as by heat sealing along the remaining side edges. The edge opposite the tubular member may be left open for filling. When filled in the manner, this edge may then be sealed to provide a sealed container or pouch in which the edge with the tubular member 12 therein becomes the top flexible edge of the pouch in use. As an alternative, the pouch may be sealed empty and filled through the tubular member 12 when the wall surrounding the same is pierced.

In the embodiments of the flexible liquid container and dispensing device shown herein, the tubular member 12 is secured in the upper wall of the pouch by means of a sleeve member 14 or means press fitted over the same. Preferably the tubular member 12 may be tapered, as for example approximately 7° from its longitudinal axis, and the sleeve member 14 which is tubular in construction is fitted over the same to rigidly secure the tubular member 12 within the pouch. The sleeve member 14 which telescopically is press fitted over the tubular member with the film therebetween is positioned to extend beyond the end of the tubular member 12 a predetermined distance which will provide a protective surface for that portion of the pouch film which extends across the opening of the tubular member 12 prior to perforation of the same. As will be seen in FIGS. 1 and 2, the sleeve member 14 has a top circumferential groove 15 positioned on the upper surface of the same and four downwardly extending vertical grooves 16 positioned along the sides of the same. The pouring structure, indicated generally at 20, is comprised of a mounting portion 22 which is generally cup shaped in form and which has located centrally thereof a tubular piercing element 24 which has a sloped or angled surface 25 designed to pierce through the film of the pouch within the tubular member. The piercing element extends on the outer surface of the mounting member with an upwardly projecting tubular portion 26 upon which a cap 29 is positioned. The mounting portion 22 of the spout structure 20 has inwardly projecting upper and lower tabs 19 which when the mounting portion is positioned on the sleeve member, may be so fixed that the tabs 19 fit into the horizontal or top groove 15 and by angular rotation of the same, may be aligned with the vertical grooves to permit telescopic movement of the mounting portion on the sleeve member 14. Thus, when the tabs 19 are aligned with the vertical grooves 16 in the sleeve member, the spout structure may be moved vertically downward with respect to the tubular member 12 and the sleeve member 14 surrounding the same to a lowered position in which the tubular piercing element 24 or the cutting edge 25 thereof will have pierced the film of the pouch within the tubular member, providing communication for the fluid through the tubular piercing member and the spout portion 26 formed integral therewith. The upper tabs 19 of the mounting portion will ride in the horizontal groove to lock or hold the pouring structure on the sleeve member after the mounting portion is depressed thereon. The cap or detachable cover 29 is positioned over the end of the spout portion 26 as it projects beyond the surface of the mounting portion of the pouring structure, for the purpose of sealing the same, after the piercing element has pierced the flexible wall of the pouch. It may be removed and fluid withdrawn from the pouch through the hollow piercing element and spout portion 26.

Figure 3:
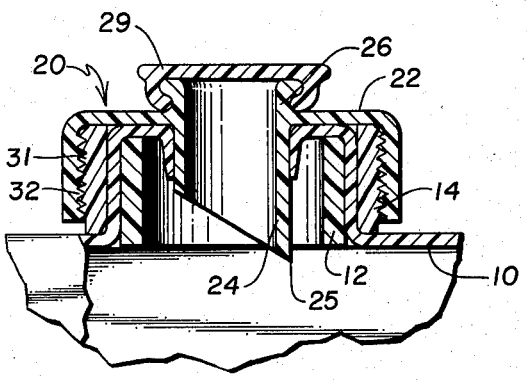
FIG. 3 is a side elevation view of another embodiment of the structure with parts broken away.
Figure 2:
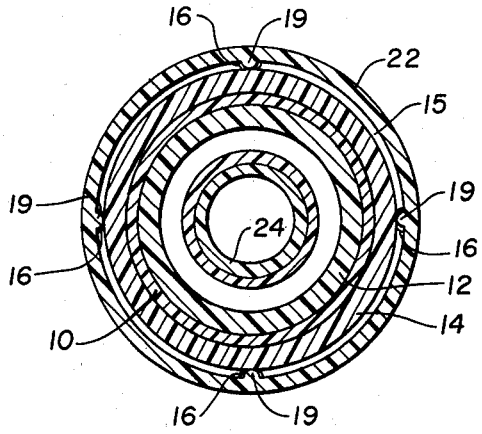
FIG. 2 is a sectional view of the structure of FIG. 1 taken along the lines 2—2 therein.

The embodiment of FIG. 3, utilizes the same type of pouring or dispensing device as that of FIGS. 1 and 2 with the exception that the coupling between the mounting portion 22 of the pouring structure and the sleeve member 14 is a threaded connection. Thus, in FIG. 3, the sleeve member 14 has a threaded surface 31 distributed along the extent of the same and the inner surface of the mounting member or portion 22 of the pouring structure has a threaded surface 32 which cooperates therewith. The tubular piercing element 24 and the spout portion 26 formed integral with the mounting portion 22 of the pouring structure remains the same as does the cap 29 which is positioned over the spout portion 26. In installing the dispensing structure on the sleeve member, the threaded surfaces 31, 32 are brought into cooperative alignment and the pouring structure or dispensing device 20 will be rotated advancing the mounting portion 22 on to the threaded surface 31 of the sleeve member 14. As it is advanced, the cutting surface or edge 25 of the piercing element will puncture the film of the pouch 10 to provide for fluid communication between the pouch and the pouring structure through the tubular piercing element 24 in the spout portion 26 formed integral therewith. In dispensing of fluid after the dispensing device or pouring structure has been installed, the cap 29 need only be removed to provide for flow of fluid from the pouch through the pouring structure.

Figure 4:
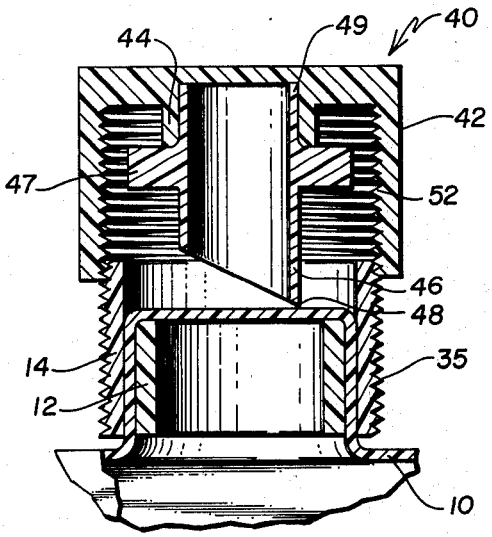
FIG. 4 is a side elevation view of still another embodiment of the dispensing structure with parts broken away and with the pouring spout structure shown in an inactive position.
Figure 5:
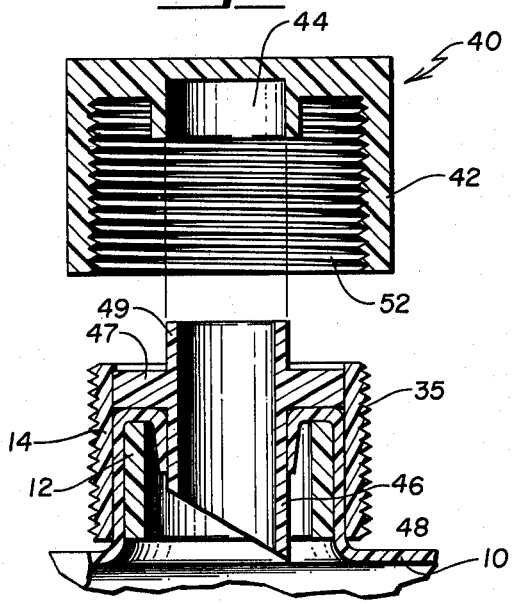
FIG. 5 is a side elevation view with parts in section of the embodiment of FIG. 4 showing the pouring spout assembly in an activated position.

The embodiment shown in FIGS. 4 and 5 shows another arrangement of the flexible liquid container with a dispensing device in which the piercing element and spout portion are carried initially by the mounting portion of the pouring structure but become detached therefrom upon opening of the pouch and are retained with the pouch. Thus, in FIG. 4, the pouch 10 with the tubular member 12 in the upper wall thereof has the sleeve member 14 mounted thereon and secured to the tubular member within the upper wall of the pouch. The upper edge of the sleeve member 14 projects beyond the end of the tubular member 12 as will be seen in FIGS. 4 and 5 and the outer portion or surface of the sleeve member is threaded as at 35. The pouring structure or dispensing device is shown at 40 as including a cup shaped mounting member 42 having an annular mounting flange 44 at the inner center thereof in which is positioned a tubular piercing element 46 having a transversely extending flange 47 thereon with a circumferential or diametrical dimension of a size to snugly fit into the portion of the sleeve member 35 positioned above the tubular member 12. The tubular piercing element 46 has its bevelled or cutting surface 48 at one extremity thereof and a tubular spout portion 49 at the other end thereof, the spout portion fitting into the annular flange 44 of the mounting member to frictionally mount the same in the inactive position. The inner surface of the mounting member is threaded as at 52 which threaded surface cooperates with the external threaded surface 35 of the sleeve member to bring the pouring structure into coupled relationship with the sleeve member. Whenever it is desired to activate the pouch, the mounting member 42 of the pouring structure is threaded down onto the sleeve member 14 causing the tubular piercing element to pierce the flexible wall of the pouch within the tubular member 12 therein and provide fluid communication with the interior of the pouch through the tubular piercing element. As the pouring structure is initially advanced onto the sleeve member 14, the flange periphery or surface 47 on the tubular piercing element 46 will fit into the end of the sleeve member 14 snugly to be retained therein. Thus, as will be seen in FIG. 5, after the flexible wall of the pouch is punctured and the tubular piercing element 46 is positioned within the upper end of the sleeve member 14, the mounting member 42 may be withdrawn by counterrotation of the threaded surfaces opening the dispensing device to permit fluid communication through the tubular piercing element and pouring spout portion 49 thereof. The mounting member 42 then serves as a cap to be replaced on the sleeve member 14 after usage to retain fluid in the pouch whenever it is not in use.

Figure 6:
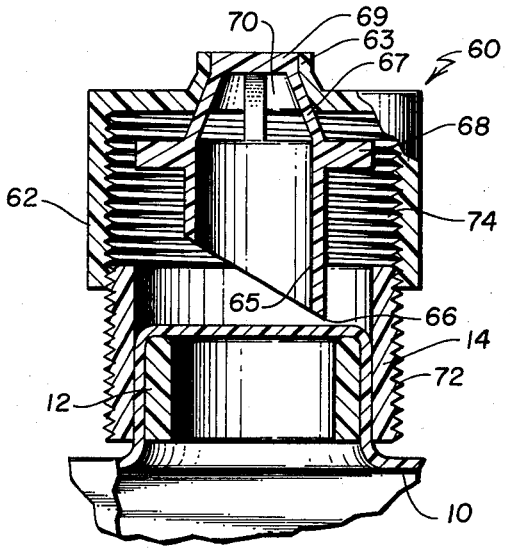
FIG. 6 is a side elevation view of still another embodiment of the dispensing structure with parts broken away and showing the dispensing structure in an inactive position; and, FIG. 7 is a side elevation view of the embodiment of FIG. 5 showing the dispensing structure in an activated position.
Figure 7:
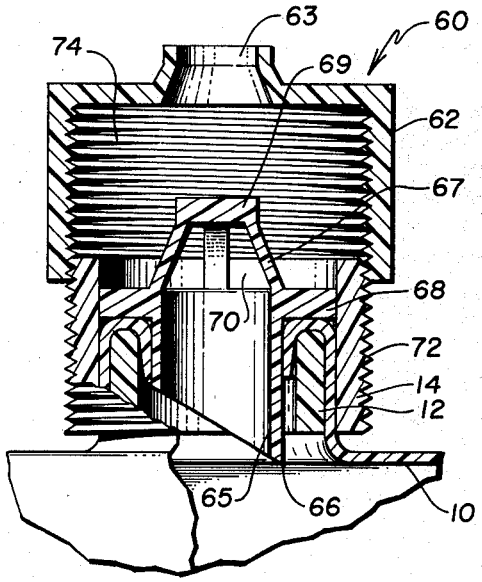

The embodiments shown in FIGS. 6 and 7 shows another variation of the structure of FIGS. 4 and 5 in which the mounting member and the tubular piercing element, after initial installation form a closable valve. Thus, in FIG. 6, the pouch 10 has the tubular member 12 positioned in an upper wall thereof with the portion of the pouch stretched across the open end of the tubular member 12 with the tubular member being retained therein by the addition of the sleeve member 14 press fitted over the same. As in the previous embodiments, the sleeve member extends beyond the end of the tubular member to provide a surface in which the tubular piercing element will be retained, as will be hereinafter noted. The pouring structure or dispensing device in this embodiment is indicated at 60 as incorporating a mounting member portion 62 generally cup shaped in form and having a raised circular opening 63 in the center thereof terminating in an annular flange. Mounted on the mounting member 62 is a tubular piercing element 65 which has a bevelled or cutting surface 66 at one end thereof, a flange portion 68 which is annular or cylindrical in form and of a dimension sufficient to snugly fit into the space within the sleeve member 14 above the tabular member 12. The upper end of the tubular piercing element has inclined surfaced 67 with slotted openings 70 therein terminating in a straight walled portion 69 adapted to fit into the annular flange portion of the recess 63 in the mounting member 62. Initially, the piercing element 65 is carried by the mounting member 62 of the pouring structure in the inactive position. The outer threaded surface 72 on the sleeve member cooperates with an inner threaded surface 74 on the cup shaped mounting member to provide a threaded connection therebetween permitting relative movement between the sleeve member and the dispensing device or pouring structure 60. As will be seen in FIG. 7, once the mounting member has been advanced onto the sleeve member 14 to cause the flange portion 68 of the tubular piercing element 65 to be housed in the upper portion of the sleeve member. The mounting member 62 may then be moved relatively away from the tubular piercing element or the spout and valve closure portion 69 thereof to provide an open passage for fluid through the tubular member, the opening 70 in the valve and spout portions 63 and the opening in the mounting member defined by rhe annular ridge 69.

In the embodiments of FIGS. 4, 5, 6, and 7, the coupling structure between the sleeve member 14 and the mounting members 40 and 60 are shown as threaded couplings. It will be understood, however, that the same detent and grooves may be positioned respectfully in the mounting members and the sleeve members to permit relative movement between the pouring structure and the sleeve member for initial piercing of the pouch wall at the tubular member 12 to provide for fluid communication to the fluid within the pouch and thereafter, removal or movement of the mounting member which may form a cap or valve part for the controlled dispensing of fluid and sealing of the pouch after usage.

In the present invention, I have provided serveral dispensing devices to be used with the flexible liquid container or pouch as described in my prior patent and co-pending application. The pouch may be supported in an outside container or may be used in its flexible form without such outside support. The dispensing devices may be installed at the time of formation of the pouch or at the time of usage to provide for communication between the pouch and the spout with the applicable closure means shown in the various embodiments. In the application of this invention, the liquid pouch will be applied with a sleeve member having an exterior surface which will permit relative movement of the pouring structure in the opening or piercing operation of the pouch. The sleeve and pouring structure also provides means for latching to retain the pouring structure on the pouch or at least a portion of the same thereon.

Therefore, in considering the present invention, it should be remembered that the present disclosure is illustrative only and the scope of the invention should be determined by the appended claims.

What I claim is:

1. In a liquid containing and dispensing device, a. a sealed liquid containing pouch having at least one flexible upper wall portion;

b. a relatively rigid tubular member positioned within the pouch and its flexible upper wall portion and being secured to the wall portion with the latter extending across one end of the tubular member in a sealing relation;

c. sleeve means positioned around the rigid tubular member with the flexible upper wall portion of the liquid containing pouch thereon and securing the tubular member in the upper wall portion of the liquid containing pouch;

d. a pouring structure including an inwardly extending tubular piercing element and mounting means carrying the same with the mounting means being fitted over the sleeve means in interengaging and telescopic relation;

e. said piercing element of said pouring structure piercing the flexible wall portion of said pouch when so mounted and extending into the tubular member to thereby bring the pouring structure into fluid communication with the interior of the pouch to facilitate pouring of the liquid from said pouch outwardly through the pouring structure; and, f. said mounting means and said sleeve means being so constructed and arranged as to permit relative interengaging and telescopic movement to cause the piercing element to secure the flexible wall portion of the pouch.

2. The liquid containing and dispensing device of claim 1 and including means positioned in part in the mounting means of pouring structure and in part on the sleeve means permitting said movement of the pouring structure relative to the tubular member to pierce said flexible wall portion of the pouch in a predetermined position.

3. The liquid containing and dispensing device of claim 2 in which the tubular piercing element is detachable from the mounting means of the pouring structure.

4. The liquid containing and dispensing device of claim 2 in which the means included in part in the mounting means of the pouring structure and in part in the sleeve means are cooperating screw thread surfaces.

5. The liquid containing and dispensing device of claim 2 in which the means included in part in the mounting means in the pouring structure and in part on the sleeve means are respectively grooves and tabs which permit relative movement of the tubular piercing element relative to the tubular member.

6. The liquid containing and dispensing device of claim 5 in which the sleeve means has a circular groove therein and transversely extending vertical grooves communicating therewith and in which the mounting means of the pouring structure includes at least one inwardly projecting rigid tab adapted to ride in the circular groove of the sleeve means and move into the vertical grooves to permit movement of the pouring structure in interengaging and telescopic relationship with the sleeve means and thereby cause the tubular piercing element to pierce the flexible wall portion of the pouch.

7. The liquid containing and dispensing device of claim 1 in which the sleeve means extends beyond the outer end of the tubular member in the pouch.

8. The liquid containing and dispensing device of claim 2 in which the means included in part in the mounting means and in part in the sleeve means includes a locking means which permits relative movement of the pouring structure relative to the tubular member while retaining the mounting means on the pouring structure on the sleeve means.

9. The liquid containing and dispensing device of claim 1 in which the mounting means carries the tubular piercing element which is detachable therefrom when the tubular piercing element is inserted into the tubular member to be carried thereby, and the mounting means effects a closure of the tubular piercing element when mounted on the sleeve means.

10. The liquid containing and dispensing device of claim 9 in which the sleeve means extends beyond the tubular element positioned within the upper wall of the pouch, and the tubular piercing element when moved relative to the tubular member is inserted within the sleeve means and the tubular member to be retained therein.

11. The liquid containing and dispensing device of claim 10 in which the tubular piercing element includes a passageway therein cooperating with a sloped aperture in the mounting means to form a valve which is closed when the mounting means and the tubular piercing element are inserted on the sleeve means with the piercing element extending through the flexible wall of the pouch in said predetermined position.

* * * * *